United States Patent [19]

Gawronski et al.

[11] Patent Number: 4,716,389

[45] Date of Patent: Dec. 29, 1987

[54] MILLIMETER WAVE MICROSTRIP SURFACE MOUNTED ATTENUATOR

[75] Inventors: Michael J. Gawronski, Minneapolis; John R. Lamberg, Minnetonka, both of Minn.

[73] Assignee: Honeywell Inc., Minneapolis, Minn.

[21] Appl. No.: 920,964

[22] Filed: Oct. 20, 1986

[51] Int. Cl.[4] ..... H01P 1/22; H01P 1/23

[52] U.S. Cl. ..... 333/81 A; 333/246

[58] Field of Search ..... 338/216, 333, 334; 333/81 R, 81 A

[56] References Cited

U.S. PATENT DOCUMENTS

| | | | |
|---|---|---|---|
| 2,668,932 | 2/1954 | Kliever | 338/333 X |
| 2,721,312 | 10/1955 | Grieg et al. | 333/238 |
| 2,725,535 | 11/1955 | Grieg et al. | 333/81 A |
| 2,810,891 | 10/1957 | Engelmann . | |
| 2,831,170 | 4/1958 | Pressel . | |
| 2,881,399 | 4/1959 | Leyton . | |
| 2,890,424 | 6/1959 | Arditi et al. . | |
| 3,176,248 | 3/1965 | McHenry . | |
| 3,505,619 | 4/1970 | Bishop . | |
| 3,564,277 | 2/1971 | Maguire . | |
| 3,654,573 | 4/1972 | Graham . | |
| 3,660,784 | 5/1972 | Scharfman . | |

*Primary Examiner*—Paul Gensler

*Attorney, Agent, or Firm*—Orrin M. Haugen; Thomas J. Nikolai; Frederick W. Niebuhr

[57] ABSTRACT

A microstrip attenuator comprising a block of lossy material which is preferably impregnated with ferrite particles and having a groove of a predetermined height and width dimension formed in the bottom surface thereof defining a tunnel and positionable upon a microstrip transmission line assembly, such that the microstrip element of the assembly passes through the tunnel, but is in non-contact relation with respect to the surface-mounted microstrip element. The degree of attenuation afforded by the attenuator is primarily a function of the aforementioned length and height dimension of the tunnel formed in the block of lossy material.

4 Claims, 2 Drawing Figures

MILLIMETER WAVE MICROSTRIP SURFACE MOUNTED ATTENUATOR

BACKGROUND OF THE INVENTION

I. Field of the Invention

This invention relates generally to millimeter wave microstrip transmission lines for transmitting RF energy, and more particularly to an improved energy absorber for fine tuning of the power being transmitted from a source to a load via said transmission line.

II. Discussion of the Prior Art

Microstrip transmission lines are well known in the art. They generally comprise a conductive ground plane upon which is placed a dielectric layer, usually coextensive with the ground plane. Usually centrally positioned atop the dielectric layer is a conductive strip of substantially lesser width than the ground plane. It has been found convenient to fabricate such microstrip transmission lines using well-known printed circuit techniques where one surface of the printed circuit board is metallized to form the ground plane and an elongated strip is etched on the opposed surface of the dielectric printed circuit board. For general information concerning the construction and operation of microstrip transmission lines, reference is made to U.S. Pat. No. 2,654,842 of H. F. Engelmann and to "Proceedings of the I.R.E.", December, 1952, pp. 1644–1650.

In many applications, it is desirable to be able to adjust the amount of RF energy being transmitted from a source to a load. Microstrip attenuators are used for this purpose. Various forms of attenuators for use with microstrip transmission media are also known in the art. These commonly take the form of fixed value, fixed position devices and are designed using standard impedance value models for either T or $\pi$ configurations. Other somewhat related microstrip attenuators are described in the Arditi et al U.S. Pat. No. 2,890,424 and the Engelmann U.S. Pat. No. 2,810,891. In these latter two patents, a piece of microwave lossy material is positioned in "resilient engagement" with the conductive strip line, and by adjusting the presssure between the lossy material and the strip line, the degree of attenuation can be varied. An undesirable variation of the attenuation, measured in dBs, can occur over time, however. This is believed to be due to either changes in the contact pressure between the attenuating pad and the strip line or in the unwanted deformation (creep) of the lossy material from which the attenuating pads are commonly fabricated due to the application of pressure.

OBJECTS

It is accordingly a principal object of the present invention to provide an improved attenuator for a millimeter wave microstrip transmission line.

Another object of the invention is to provide an attenuator for a microstrip transmission line, which is formed from a rigid material and whose attenuation parameter remains constant over time and exhibits good impedance matching characteristics for all values of attenuation.

Still another object is to provide an improved microstrip transmission line attenuator which is low in cost and which can be readily tailored to provide a desired attenuation value.

SUMMARY OF THE INVENTION

The attenuator of the present invention comprises a block of fairly rigid, non-deformable microwave lossy material which preferably is impregnated with ferrite particles and which has a planar surface. Formed in the planar surface thereof is a groove of a predetermined width and height so that when the block is positioned atop the microstrip assembly, it can rest upon the dielectric layer, while straddling only the strip line in a non-contact relation. By varying the length of the block and/or the height of the tunnel above the microstrip, the amount of attenuation can be tailored to the application.

The foregoing objects and advantages of the invention will become more apparent to those skilled in the art from the following detailed description of a preferred embodiment, especially when considered in conjunction with the accompanying drawings in which like numerals in the several views refer to corresponding parts.

DESCRIPTION OF A PREFERRED EMBODIMENT

Figure 1:
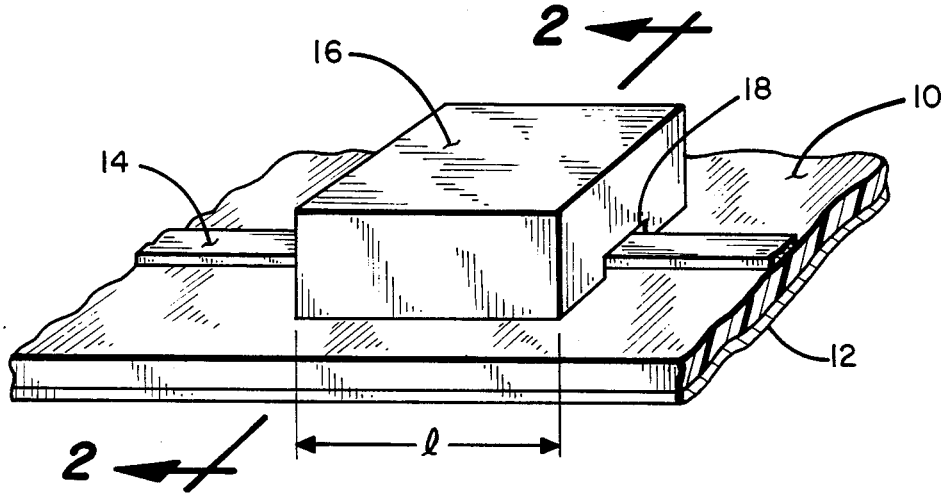
FIG. 1 is a perspective view of a microstrip transmission line assembly along with the attenuator of the present invention.
Figure 2:
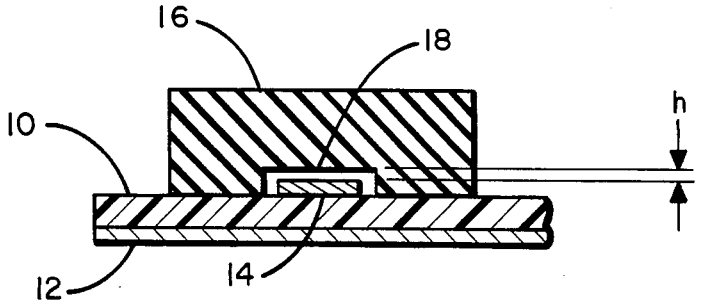
FIG. 2 is a cross-sectional view taken along the line 2—2 in FIG. 1.

Referring to FIG. 1, there is shown a portion of a microstrip transmission line in somewhat enlarged fashion and it is seen to comprise a dielectric layer 10 having a metallized undersurface 12 comprising the ground plane and formed on the opposed surface of the dielectric layer is a conductive strip 14. Resting atop the dielectric layer 10 is the microstrip attenuator 16 which is in the form of a shaped piece of lossy material such as Eccosorb ® MF-S available through Emerson & Cumming Company. This material comprises a silicone rubber matrix in which ferrite particles are generally uniformly distributed. It is also contemplated, however, that the lossy material have a non-homogeneous distribution of ferrite particles to provide still other characateristics to the attenuator.

Formed in the base of the block 16 is a groove 18 comprising a tunnel through which the microstrip line 14 passes. That is to say, when the block 16 is positioned atop the dielectric substrate 10, the strip line 14 passes through the groove or tunnel 18 in a non-contact relationship with the block 16.

The degree of attenuation for the microwave energy of a given wave length is determined by the mechanical dimensions of the block 16. Specifically, the length, l, of the absorber and the height, h, above the RF line 14, as well as the type of absorptive material used in forming the block 16 determines the degree to which the signal being transmitted will be attenuated. Specifically, it has been found that the degree of attenuation is inversely porportional to the height of the tunnel 18 above the microstrip line conductor 14.

The table below shows the manner in which the attenuation of power in dB's varies with the tunnel geometry of the attenuator 16 for a millimeter wave having a frequency of 35.0 GHz. In the experimental test set-up, the substrate 10 was Duroid R 5880 material, available from Rogers Corporation, 0.120 inch wide and 0.01 inch thick and the metalized layer 12 being 1/2 oz. rolled copper. The microstrip line 14 was 0.031 inch wide and a 50 ohm construction. The attenuator material was Eccosorb MF-S-124 produced by Emmerson and Cumming, Inc. Its dimensions were 0.25 inch long, 0.130 inch high and 0.120 inch wide. The tunnel was 0.063 wide and its height dimension was the independent variable. Table I below shows the way in which attenuation and return loss vary with tunnel height.

TABLE I

MEASURED ATTENUATION OF SURFACE MOUNTED MICROSTRIP ATTENUATOR

| Tunnel Height H (Inch) | Attenuation (dB) | Return Loss (dB) |
|---|---|---|
| 0.035 | 0.8 | 16.4 |
| 0.025 | 1.7 | 16.4 |
| 0.018 | 2.1 | 17.1 |
| 0.014 | 2.9 | 18.4 |
| 0.010 | 3.5 | 17.3 |
| 0.007 | 4.5 | 18.7 |
| 0.003 | 6.9 | 22.4 |

MEASUREMENT FREQUENCY = 35.0 GHZ

As can be seen from the table, the attenuation variation is quite smooth and when plotted as a function of tunnel height exhibits a range of substantial linearity. Also, the VSWR (return loss) measurement evidences that the attenuator provides a good impedance match for all values of attenuation.

The attenuator of the present invention is bi-directional and by appropriate dimension selection and appropriate attenuator material selection, it can be designed to work at desired specified frequencies appropriate for microstrip transmission lines and with any type of substrate material, with substrates of a lower dielectric constant affording somewhat better performance from the attenuator than when a substrate of a high dielectric constant is used. Furthermore, the attenuator is not limited to a closed microstrip construction, but operates equally well with an open microstrip. It is compatible with other microstrip component designs. That is to say, it can be made very small in size so as to be compatible with other system requirements. The microstrip attenuator of the present invention works by attenuating the electromagnetic fields in the air immediately around the strip conductor.

While there has been shown and described a preferred embodiment of the invention, it will be recognized by those skilled in the art that various changes and modifications may be made to the embodiment disclosed while still taking advantage of the teachings hereof. Accordingly, the scope of the invention is to be determined from the following claims.

What is claimed is:

1. An attenuator for a microstrip transmission line assembly of the type having an elongated conductive microstrip spaced from a conductive ground plane by a layer of solid dielectric material, comprising:

a substantially rigid, non-deformable block of electromagnetic energy absorbing material, said block having at least one planar surface, save for a groove formed inwardly of said planar surface into said block, said block resting on said layer of solid dielectric material with said conductive microstrip aligned with said groove so as to straddle only said conductive microstrip in a non-contact relationship and only over a predetermined length of said conductive microstrip.

2. In a microstrip transmission system of the type having a ground plane and a conductive strip separated from one another by a solid dielectric layer, the conductive strip being of substantially lesser width than said ground plane, a power attenuator comprising:

a piece of radio-frequency energy absorbing material having at least one generally planar surface and a longitudinal groove of a predetermined width and height dimension formed in said generally planar surface, said planar surface of said block of energy absorbing material being positioned on said solid dielectric layer with said longitudinal conductive strip fitting within said groove in a non-contacting manner.

3. The device as in claim 1 or 2 wherein said energy absorbing material comprises a silicon rubber impregnated with ferrite particles.

4. The device as in claim 1 wherein the degree of attenuation is inversely proportional to the depth of said groove.

* * * * *